US005281858A

United States Patent [19]

Langved

[11] Patent Number: 5,281,858

[45] Date of Patent: Jan. 25, 1994

[54] FLUID LEVEL ACTIVATED FLOAT SWITCH

[76] Inventor: Arthur Langved, Rte. 2, Box 16, Newtown, N. Dak. 58763

[21] Appl. No.: 944,616

[22] Filed: Sep. 14, 1992

Related U.S. Application Data

[63] Continuation-in-part of Ser. No. 894,494, Jun. 5, 1992, abandoned.

[51] Int. Cl.[5] ..... H01H 35/18

[52] U.S. Cl. ..... 307/118; 73/308; 200/84 R; 340/625; 361/178

[58] Field of Search ..... 307/118, 141.8; 340/623, 625; 417/40; 73/308, 313, 317; 318/3, 466; 361/178, 166, 170, 191; 200/61.2, 61.52, 84 R, 186, 190, 220, 230

[56] References Cited

U.S. PATENT DOCUMENTS

| | | | |
|---|---|---|---|
| 2,570,694 | 10/1951 | Langenbahn . | |
| 3,195,512 | 7/1965 | Jackson . | |
| 3,437,770 | 4/1969 | Piernik . | |
| 3,733,447 | 5/1973 | Schneider, Jr. . | |
| 3,752,945 | 8/1973 | Achteiberg . | |
| 3,944,770 | 3/1976 | Pepper . | |
| 4,262,216 | 4/1981 | Johnston | 361/178 |
| 4,373,155 | 2/1983 | Dola . | |
| 4,399,338 | 8/1983 | Jones | 200/84 R |
| 4,540,891 | 8/1985 | Keener | 307/118 |
| 4,644,117 | 2/1987 | Grimes et al. . | |
| 4,692,576 | 9/1987 | Frede . | |
| 5,025,827 | 6/1991 | Weng | 137/392 |
| 5,087,801 | 2/1992 | Johnston . | |
| 5,155,308 | 10/1992 | Blair . | |

FOREIGN PATENT DOCUMENTS

| | | | |
|---|---|---|---|
| 438342 | 12/1926 | Fed. Rep. of Germany | 200/61.52 |
| 2788846 | 3/1979 | Fed. Rep. of Germany | 200/84 R |
| 1073558 | 6/1967 | United Kingdom | 200/84 R |

*Primary Examiner*—Gerald P. Tolin
*Attorney, Agent, or Firm*—Haugen and Nikolai

[57] ABSTRACT

A fluid level responsive switch apparatus used in a tank to monitor fluid level in the tank. The apparatus has a float buoy attached to a tilt switch containing three conductors activated by a conductive sphere. The first conductor activates the fluid controller for restoring fluid to the tank when the conductive sphere is in a low fluid level position, the second conductor delays the switching between the activating and deactivating conductors when the conductive sphere is in an intermediate level position and the third conductor deactivates the controller when the conductive sphere is in a high fluid level position.

18 Claims, 7 Drawing Sheets

FLUID LEVEL ACTIVATED FLOAT SWITCH

Reference to Co-pending Application

The present application is continuation in part of application Ser. No. 07/894,494, filed on Jun. 5, 1992 now abandoned entitled "Fluid Level Activated Float Switch."

BACKGROUND OF THE INVENTION

Field of the Invention

The present invention relates to a fluid level activated electrical switch and more particularly to a float switch for use in conjunction with a controller to automatically restore or drain fluid to a desired level by supplying power to a pump motor or a solenoid operated valve.

Switches responsive to fluid levels have utilized a variety of approaches for opening and closing an electrical circuit. Fluid level switch devices usually incorporate a float buoy for sensing the fluid level, the float buoy being operatively connected to a switch device. Mercury switches provide excellent switching characteristics and are readily adaptable to fluid level actuated float switches. They usually consist of a sealed glass tube of mercury into which a pair of electrodes extend. When tipped at a predetermined angle, the mercury will travel through the tube to bridge a gap between the two electrodes to actuate the switch. However, mercury is a hazardous material and there has been movement away from its use in float switches, especially where breakage of the glass tube is possible.

One alternative to a mercury-switch based float switch has been to replace the mercury tube with an enclosed raceway containing a conductive sphere. The sphere travels through the raceway as the float buoy moving up and down according to the fluid level tips the switch member. The sphere will contact an arm or yoke which will activate or deactivate the load, as disclosed in U.S. Pat. No. 5,087,801 to Johnston, U.S. Pat. No. 3,944,770 to Pepper, U.S. Pat. No. 4,592,576 to Frede, U.S. Pat. No. 4,644,117 to Grimes her conductive spheres contact conductive strips etched onto the raceway such as disclosed in U.S. Pat. No. 3,733,447 to Schneider, Jr.

A problem arises when the fluid levels monitored do not change uniformly. Wave action, for example, may cause prior art devices to switch on and off frequently and erratically causing burn out of the attached motors.

Therefore, what is needed is a fluid level responsive electrical float switch which does not subject the motor to erratic energization, a cause of burnout The present invention solves this problem by providing a conductive ball to make a direct contact with conductive switch contacts in three different positions, one of which is a neutral, intermediate position, within a fluid level activated float switch. The neutral intermediate position of the present invention operates as a delay mechanism which prevents wave action in the fluid from turning on and off the load.

SUMMARY OF THE INVENTION

The present invention is a fluid level responsive float switch consisting of a tilt switch attached to the arm of a hinged float buoy. The tilt switch includes wire contact elements spanning the interior of a casing and a conductive ball held in position by the contact wire elements The float buoy rises and falls with the level of the fluid being regulated. When the fluid being regulated is high, the float buoy is in a position such that the tilt switch on the arm of the hinged float is tilted back towards the hinge. The conductive ball is held in position by the contact elements of a first and second conductor. When the float is in the neutral intermediate position, the ball repositions and is held by the contact elements of only the second conductor. When the fluid being regulated is low the float buoy is in a third position, the plastic case tilts downward away from the hinge and the ball repositions to be held by the contact elements of both the second and third conductor.

The activation or deactivation of the load results from the position of the conductive ball in the tilt switch. To accomplish switching of a power relay for the activating or deactivating of the load, two six volt control relays are utilized. The first control relay is a single pole, single throw, normally closed relay and the second control relay is a double pole, single throw, normally opened relay. When the float switch is in one position, such as when the fluid being monitored is low, the ball is held in position by bridging the contact elements of the second and third conductors. This causes one pole of the normally open, second control relay to close. When the second control relay closes, the power relay is activated and power is supplied to the load. The other pole completes a circuit parallel to the conductive ball. As the float position changes with the fluid level and the ball repositions to its neutral position contacting only the second conductor. In the neutral position, a delay is imposed and the load remains on because of the latching action of the pole that is in parallel with the ball. Likewise, the neutral position also imposes a delay when switching from off to on as the fluid level drops. When the fluid level is high, the ball repositions within its housing to bridge the contacts of the first conductor and the neutral conductor. This will temporarily open the normally closed relay and break the latching circuit holding the second control relay closed. When the second control relay returns to its open position and the power relay disengages, stopping the flow of power to the load.

In an alternative circuitry arrangement a single throw, three pole normally open relay replaces the power relay and the two control relays. When the relay is energized, the load to the pump is on. When the relay is de-energized, the load to the pump is off. The circuit shunts the relay coil when the fluid level is high to disconnect the power to the load. In another alternative circuitry arrangement, a two coil latching relay can be used to replace the power relay and two control relays. Power is supplied to the pump when the latching relay is energized to close its poles. Power is cut off to the pump when the latching relay is energized and the poles open.

OBJECTS

The primary object of the present invention is to provide a reliable and accurate fluid level responsive float switch which is highly resistant to turning on and off due to wave action thereby protecting any connected motor from burn out.

Another object of the invention is to provide a fluid level actuated float switch which does not use hazardous material such as mercury.

Yet another object is to provide a fluid level activated float switch which operates at a low voltage near the fluid and tanks so that people or animals are not in danger from accidental electrocution.

Still another object is to provide a fluid level activated switch having more versatility.

These and other objects of the present invention will become apparent to those skilled in the art upon a study of the following specification, pending claims and accompany drawings.

DETAILED DESCRIPTION OF THE PREFERRED EMBODIMENT

Figure 1:
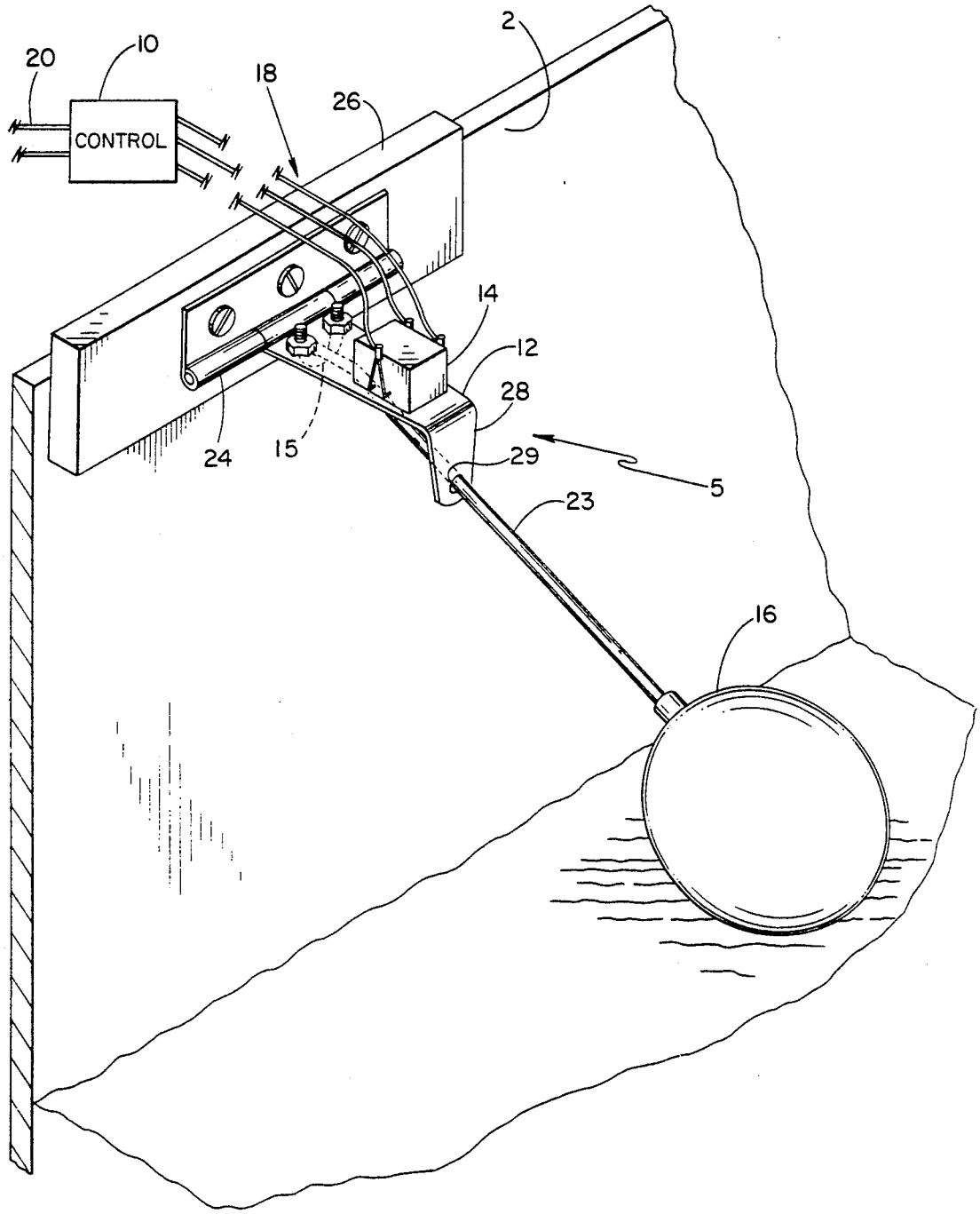
FIG. 1 is a side view of the float switch in accordance with the present invention.
Figure 2:
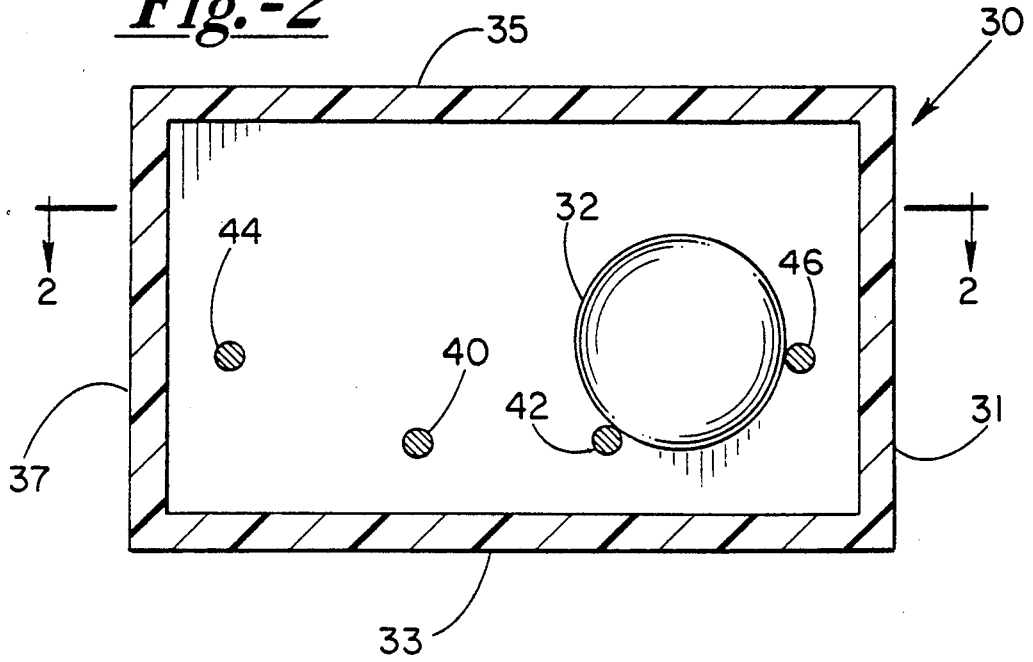
FIG. 2 is a side-sectional view of the interior of the tilt switch of the present invention.

The present invention is a float switch responsive to fluid level changes. As shown in FIG. 1 the invention, designated generally by numeral 5, has a control box 10, and arm member 12, a tilt switch 14, a float buoy 16 and electrical connecting leads 18 and 20. Float buoy 16 and tilt switch 14 are located in the tank 2 whose fluid level is being controlled.

The tilt switch 14 is located on an hinge arm 12. Hinge arm 12 is pivotally hinged at 24 and connected to a support member 26. Support member 26 is ideally an elongated bar for securing the float buoy 16 and tilt switch 14 to the edge of tank 2 being regulated. As shown in FIG. 1, hinge arm 12 has a bent end 28 to allow the required tilt angle for operation of the present invention. Buoy stem 23, attached to the base of hinge arm 12 by U bolt 15, extends through opening 29 on the bent end 28 after hinge arm so as to inhibit lateral sway of the float buoy 16. Float buoy 16 a conventional toilet ball or, alternatively a piece of buoyant foam. The float rod 23 is designed to telescope into float buoy to provide adjustment of the rod length. By adjusting the position of the float buoy 16 on the float rod, the fluid level drop between the "on" and "off" cycles can be varied.

Figure 3:
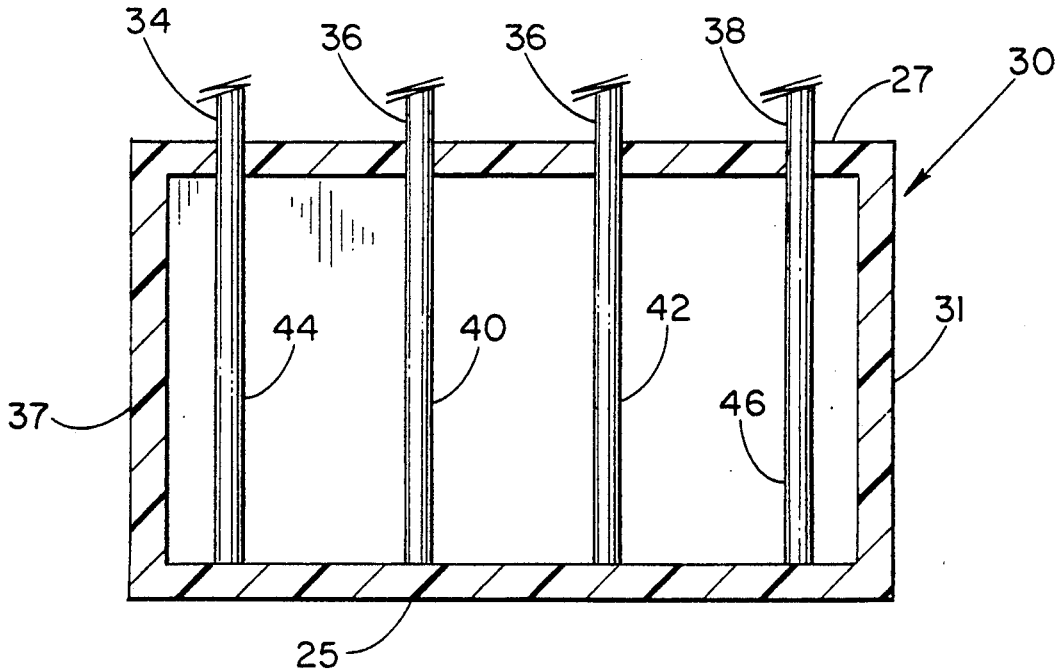
FIG. 3 is a cross-sectional view showing the interior of the tilt switch of the present invention and taken along the line 2—2 in FIG. 2.
Figure 4A:
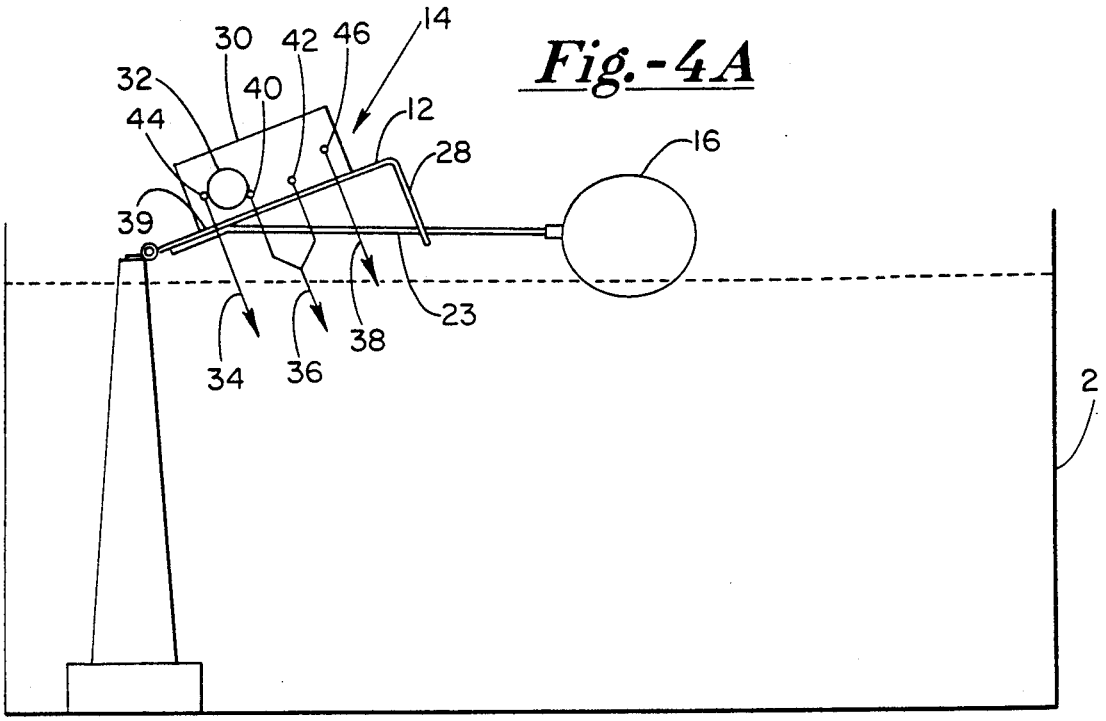
FIGS. 4A–4C are schematics of the present invention showing the location of the float buoy and conductive sphere of the invention with respect to the fluid level.
Figure 4B:
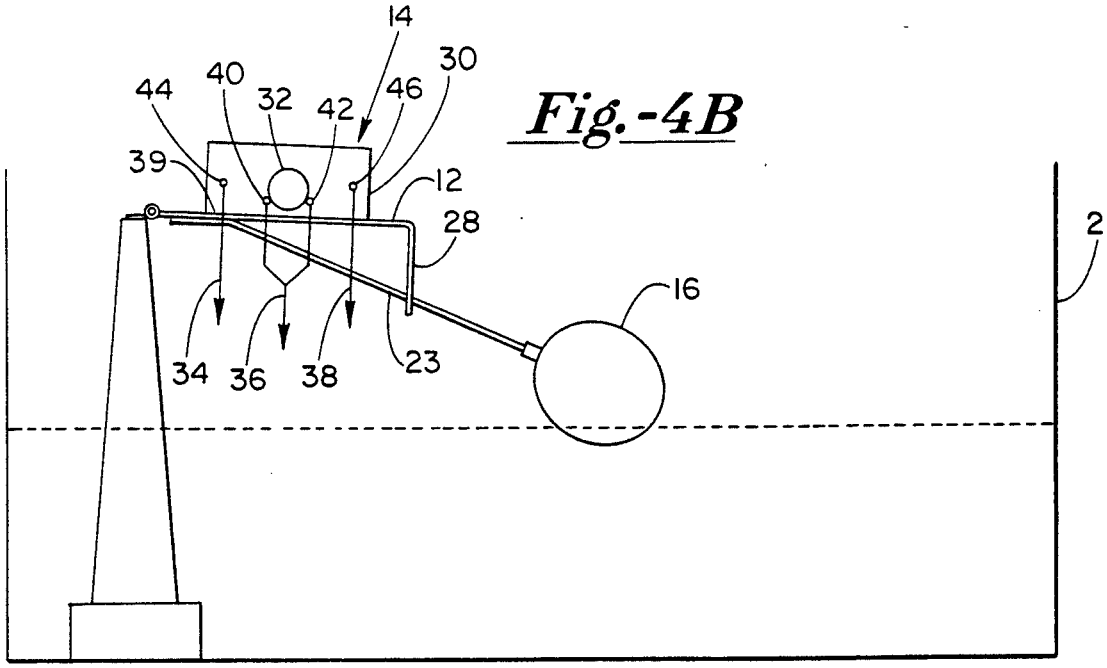
Figure 4C:
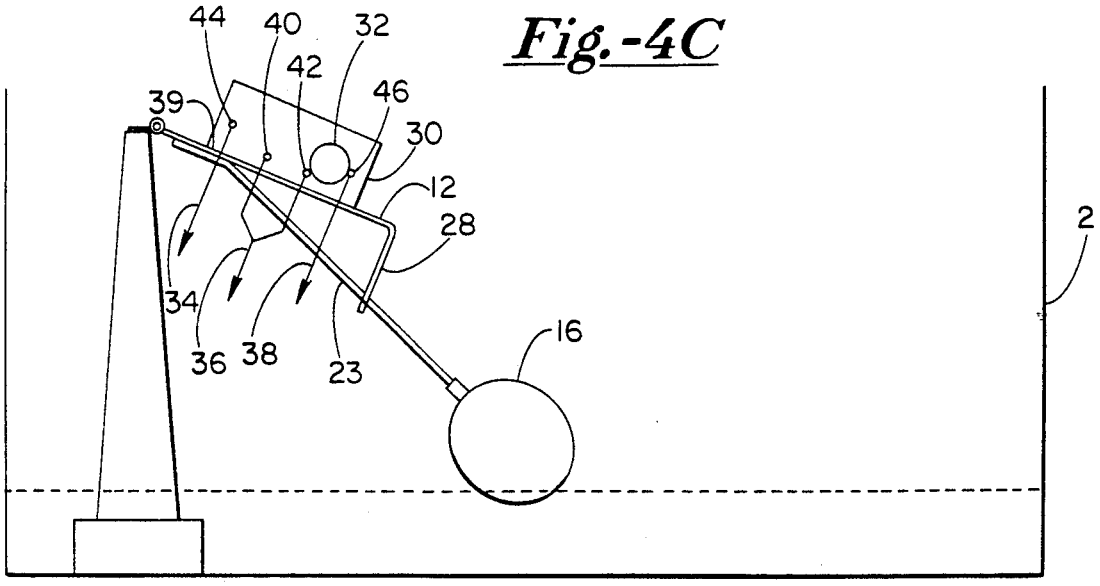

Tilt switch 14 as shown in FIGS. 4A–4C has a plastic case 30 totally enclosing a metal conductive ball 32 and three wire conductors designated 34, 36 and 38. The case is a generally rectangular closed box with side walls 25 and 27, end walls 37 and 31, base 33 and top 35 as shown in FIG. 2 and 4A–C. The conductors 34, 36 and 38 extend through the wall 27 of the case, as shown in FIG. 3 and serve as contact elements within the case 30 for supporting the conductive ball 32 in the manner to be described.

Contact elements 40 and 42 tied to the second conductor 36 are located in the lower portion of case 30 and spaced apart parallel relationship as shown in FIG. 4. Contact element 44 connected to the first conductor 34 and contact element 46 connected to the third conductor 38 are located on opposing sides of contact elements 40 and 42 and are vertically displaced to reside in the upper portion of case 30. These contacts are spaced to hold ball 32 in three discrete positions as the case is tipped from the horizontal in the clockwise or counterclockwise direction. In the high fluid level position ball 32 bridges contact elements 40 and 44 as shown in FIG. 4A. In the intermediate fluid level position ball 32 bridges contact elements 40 and 42 as shown in FIG. 4B. In the low fluid level position ball 32 bridges contact elements 42 and 46 as shown in FIG. 4C.

Figure 5:
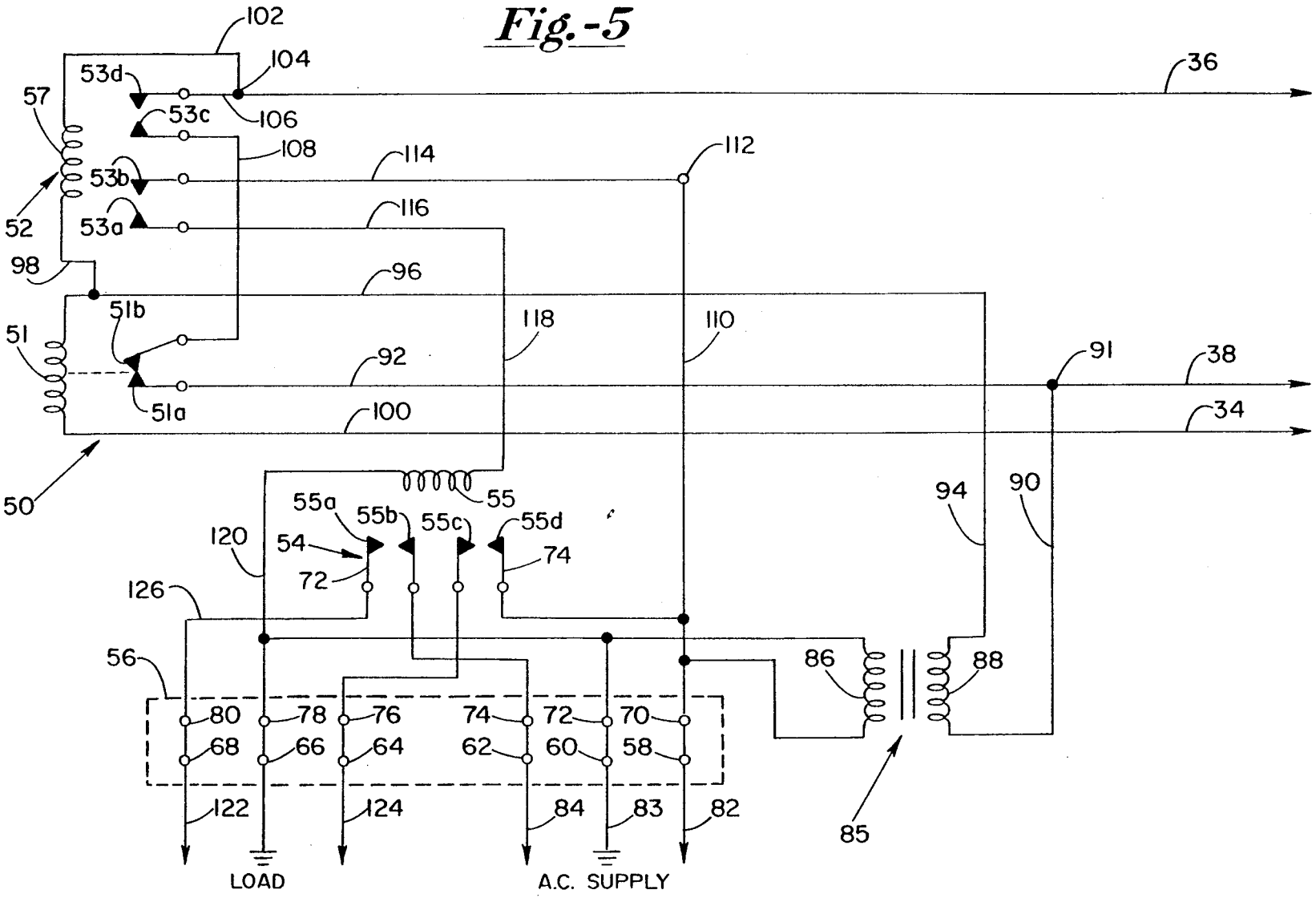
FIG. 5 is a schematic of the circuitry in the present invention.

Turning now to FIG. 5, the circuitry contained within the control box 10 of FIG. 1 will now be explained. The control circuit includes a first control relay 50 having a relay coil 51 which, when energized, functions to open the normally closed contacts 51(*a*) and 51(*b*). A second control relay 52 has a relay coil 53 which, when energized, functions to close the normally open contact pair 53(*a*) and 53(*b*) as well as the contact pair 53(*c*) and 53(*d*). Also included is a power relay 54 having a relay coil 55. The contacts 55(*a*) and 55(*b*) and the contacts 55(*c*) and 55(*d*) are normally open but become closed when the coil 55 is energized.

A terminal strip 56 includes a plurality of tie points 58, 60, 62, 64, 66 and 68 which are adapted to be connected by jumper links to a corresponding plurality of tie points 70, 72, 74, 76, 78 and 80. The conductors 82 and 84 are adapted to be connected to a source of line voltage, such as a 220 volt supply or 120 volt supply, such that 110 volts exists between tie point 60 which is connected to ground. A primary winding 86 of a voltage step-down transformer is connected across the tie points 70 and 72 and, thus, the primary voltage will be 120 volts. The secondary winding 88 of the step-down transformer 85 may develop six volts across it.

Conductor 38, leading to contact 46 of the tilt switch, connects to one side of the secondary winding 88 of the step-down transformer 85 by way of a conductor 90 and it also is connected by a conductor 92 to the contact 51(*a*). The other side of the secondary winding 88 is connected by a conductor 94 and a conductor 96 to one side of the relay coil 51. It is also connected by the conductor 94 and a further conductor 98 to a first side of the relay coil 53. The second side of the relay coil 51 is connected by a conductor 100 to the conductor 34 which, as mentioned, joins to the contact 44 in the tilt switch. The remaining terminal of the relay coil 53 is connected by a conductor 102 to a junction point 104 to which the conductor 36 joins. Conductor 36 leads to the contacts 40 and 42 of the tilt switch.

Conductor 36 also is joined to the relay contact 53(*d*) by way of conductor 106 and its mating contact, 53(*c*), is connected by a conductor 108 to the normally closed contact 51(*b*). With continued reference to FIG. 5, the tie point 70 on the junction strip 56 is connected by a conductor 110 to a junction 112 to which the normally open contact 53(*b*) connects, via conductor 114. The contact 53(*a*) is joined by conductors 116 and 118 to the relay coil 55. The other terminal of the coil 55 is coupled by a conductor 120 to grounded terminal point 78.

The load to be controlled is adapted to be connected across the lines 122 and 124. The load may, for example, be a pump for introducing additional water into the tank. The load terminal 122 is connected via terminal strip 56 and a conductor 126 to the contact 55(*a*) while the line 124 is connected via the terminal strip and a conductor 128 to the contact 55(*c*). Contact 55(*b*) is joined by a conductor 130 to one side of the AC line while the other AC line 82 is joined via terminal strip contacts 58–70 and a conductor 132 to the contact 55(*d*).

Figure 6:
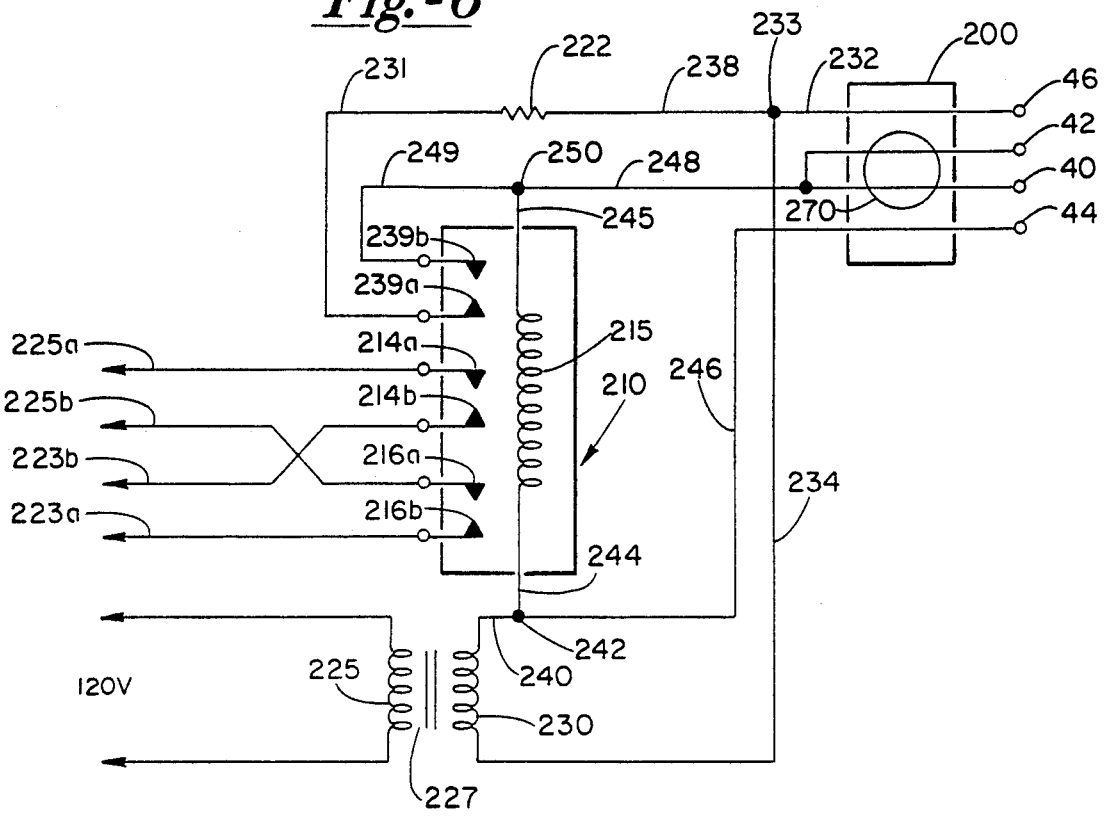
FIGS. 6 and 7 are schematics of alternate embodiments of the circuitry in the present invention.

Turning now to FIG. 6, a first alternative embodiment of the circuitry control is shown. The control circuit includes a three pole, single throw normally open relay 210 having a relay coil 215. This relay replaces the power relay and the two control relays of the first embodiment When energized, relay coil 215 functions to close normally open contact pair 214(*a*) and 214(*b*) as well as contact pair 216(*a*) and 216(*b*). The control circuits also include a current limiting resistor 222 disposed between the relay 210 and the tilt box 200. Conductors 223*a* and 223*b* lead to the pump's power source. Conductors 225*a* and 225*b* lead to the pump motor.

The primary winding 225 of voltage step down transformer 227 is connected to 120 volts. The secondary winding 230 may develop 6 volts across. Conductor 232 leading to the contact 46 of tilt switch 200 connects to one side of the secondary winding 230 of the step down transformer 227 by way of conductor 234 which in turn is connected to conductor 232 at junction point 233. Current limit resistor 222 is connected to junction point 233 by conductor 238 and contact 46 by conductor 232. Conductor 231 leads from current limiting resistor 222 to mating contact 239(*a*).

The other side of the secondary winding 230 is connected by conductor 240 to junction point 242. Conductor 246 leads from junction point 242 to contact 44. Conductor 244 leads from junction point 242 to relay coil 215 and conductor 245 leads from the relay coil 215 to junction point 250. Contact elements 42 and 40 are connected to the relay coil 215 through conductor 248 by way of junction point 250 and conductor 245. Contact elements 42 and 40 are also connected to mating contact 239(*b*) through conductor 248, junction point 250 and conductor 249.

Figure 7:
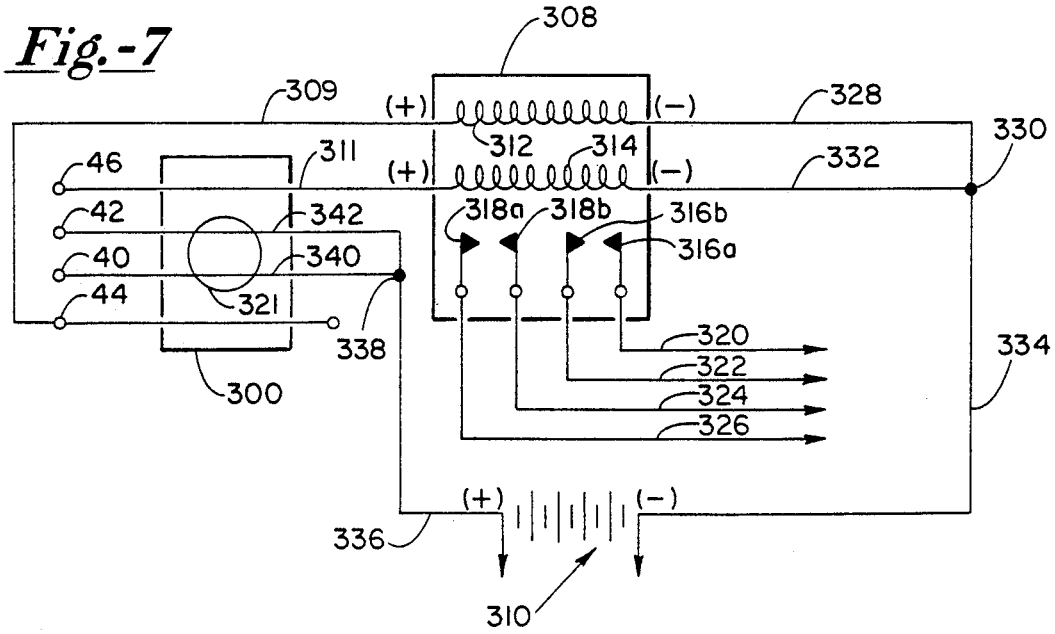

Turning now to FIG. 7, another alternative control circuit is disclosed. In this circuit arrangement, the two relays of the preferred embodiment are replaced with a two coil latching relay 308. This relay 308 requires D.C. Adaptor, designated generally as 310, to change in 120V AC to 12 V DC.

Contact 44 of tilt switch 300 is in series with coil 312 of latching relay 308 via conductor 309 and contact 46 of tilt switch 300 is in series with coil 314 of latching relay 308 via conductor 311. When coil 314 is energized, the contact pair 316(*a*) and 316(*b*) close as do contact pair 318(*a*) and 318(*b*). When coil 312 is energized, the contact pairs open. Conductors 320 and 322 lead from the power source for the pump being regulated to contact elements 316(*a*) and 318(*b*) respectively. Conductors 324 and 326 lead to the pump motor. Conductor 328 is located between coil 312 and junction point 330. Conductor 332 is located between coil 314 and junction point 330. Between junction point 330 and DC adaptor 310 is conductor 334. The DC adaptor is also connected to a power source (not shown) which will provide 120 V AC. Conductor 336 leads from DC Adaptor 310 to junction point 338 from which contacts 40 and 42 of tilt switch 300 are joined.

MODE OF OPERATION

The device is operatively positioned to monitor fluid level such as fastening it to the edge of the tank 2 as shown in FIG. 1, or to a post anchored with a submerged weight in the interior of the tank such as shown in FIG. 4A–4C. The float buoy 16 will rise and fall with the level of the fluid being regulated as shown by FIGS. 4A–4C. The position of the tilt switch and buoy 16 shown in FIG. 4C is the proper position for the device 5 when the tank 2 is empty. The control pump must be activated to fill the tank 2. The tilt switch 14 and arm 12 is tilted away from the support member 26. The conductive ball 32 is positioned to bridge the contact elements 42 and 46 of conductors 36 and 38.

With the conductive ball bridging the contacts 42 and 46 and with the 110 voltage applied across the supply lines 82 and ground 83, a current will flow from one side of the secondary winding 88 of the transformer 85 and through conductors 94 and 98 and thence through the relay winding 53 and conductor 102, the conductive ball and the conductor 90 back to the other side of the secondary winding. Thus, relay coil 53 will be energized causing relay contacts 53(*a*)–53(*b*) to close and 53(*c*) and 53(*d*) to also close. When contacts 53(*a*) and 53(*b*) mate, a current path is established the AC supply line 82 through conductor 110, conductor 114, the now-closed contacts 53(*a*)–53(*b*), conductor 116 and conductor 118 to the relay coil 55 whose other terminal is connected by a conductor 120 to ground. Hence, the relay coil 55 will be energized such that contact 55(*a*) mates with contact 55(*b*) and contact 55(*c*) mates with contact 55(*d*). At this time, relay coil 51 remains unenergized and contacts 51(*a*) and 51(*b*) remain closed.

It is immediately apparent from the schematic diagram of FIG. 5 that when the relay 55 is energized, the 220 volt AC supply becomes connected across the load lines 122 and 124 leading to the pump. Hence, the pump will be energized and will begin introducing water into the tank. As the water continues to flow into the tank, the float buoy will rise. A point will be reached when the ball 32 will assume the intermediate position shown in FIG. 4B bridging contacts 40 and 42, each of which are tied to the conductor 36. However, since contacts 53(*c*) and 53(*d*) of relay 53 have previously been closed, relay 53 still remains energized via the current from the secondary winding 88 flowing through path including conductor 94, conductor 98, coil 53, conductor 102, conductor 106, contacts 53(*c*) and 53(*d*), conductor 108, contacts 51(*a*) and 51(*b*), the conductor 92 and conductor 90 back to the other side of the secondary winding. Thus, even though the ball is shifted to the intermediate fluid level position, the pump remains energized through the contacts of the power relay 55.

Finally, when the water level reaches the point where the ball in the float switch 14 moves to the high fluid level position shown in FIG. 4A so as to bridge the contacts 40 and 44, the current will now flow from the secondary winding 88 of the step-down transformer, via conductors 94 and 96 through the relay coil 51 and then via conductor 100 and the conductive ball to conductor 36 and thence through conductor 106, contacts 53(*d*) and 53(*c*), then via conductor 108 to 51(*b*) and 51(*a*) back to the other side of the step-down transformer secondary winding 88. As such, both relay coils 51 and 53 will be energized. Once relay coil 51 energizes, its contacts 51(*a*) and 51(*b*) break interrupting the current flow through the relay coil 53, causing contacts 53(*a*) and 53(*b*) to break and contacts 53(*c*) and 53(*d*) to also break. When this happens, of course, the current path for the relay coil 55 is interrupted causing its contacts 55(*a*)–55(*b*) and 55(*c*)–55(*d*) to break, disconnecting the AC supply from the load. Thus, the pump will stop at this point. The circuit will remain open when wave action causes the conductive, ball 32 to be repositioned between the high level position and intermediate fluid level position.

The conductive ball 32 does not alter positions just between the contacts for activating and deactivating first and third conductors. Instead, the ball 32 contacts an intermediate pair of contact elements 40 and 42. Contacts 53c–53d of the second control relay 52 is in parallel arrangement with the ball 32 when the controller is on and the ball is in the high fluid level position shown in FIG. 4C. This same contact pair is in series with the conductive sphere 32 when the controller is off and ball 32 is in the high fluid level position shown in FIG. 4A. The ball 32 is in series with the voltage source when in the high fluid level and the low fluid level positions. Float switch contacts 40–42 merely delays the switching. Thus, as the tank 2 is filling and the tilt switch 14 is pivoted counterclockwise, the ball 32 rolls from the low fluid level position to the intermediate fluid level position. The load will remain on although the ball 32 has released its contact from the low fluid level position. The load cannot be deactivated until the ball 32 repositions itself into high fluid level position. Likewise, as the tank 2 is draining and the tilt switch 14 is pivoted clockwise, the ball 32 repositions itself from between the first conductor 34 location, which deactivated the pump to the intermediate conductor 36. The controller cannot be activated until the conductive ball 32 repositions itself between the contact elements 42 and 46 of the second and in the low fluid level position.

The intermediate fluid level position is an advantage because the fluid level when rising or falling is not smooth. The fluid responsive switches responds to wave action. The intermediate fluid level position will prevent the sphere from repositioning between the contact elements activating and deactivating the pump because of wave action. This avoids continual activation and deactivation which will burn out the pump motor. The apparatus is therefore highly resistant to turning on and off due to wave action.

The ball 32 in the tilt switch 14 may remain in the off position for an extended period of time. The six volt source of energy for the activating first control relay 50 to the open position is in series with contacts 53(c) and 53(d) of the second control relay 52 and thus also becomes deactivated. Thus, the first control relay 50 opens and closes again to the rest position quickly.

The first alternative embodiment of the circuitry control shown in FIG. 6 operates as follows. As the metal ball in the tilt switch makes contact between elements 42 and 46, it completes the circuit of the secondary 230 of the step down transformer 227. The relay 210 closes since the coil 215 of the relay 210 is in series in this circuit. The pole of the relay 210 containing contact 239(a) and 239(b) is in parallel to the metal ball 270 and holds the completed circuit through the relay coil 215 as the metal ball 270 repositions itself when the fluid level rises.

When the fluid level rises to the point where the metal ball 270 repositions to contact elements 40 and 44 of the tilt switch, it completes a circuit which shunts the coil 215 of the relay 210. This shunt has a much lower resistance than the relay coil 215, so the current flow bypasses the coil 215 and there is no difference of potential across the coil 215. This causes the contacts in relay 210 to open, disconnecting the power to the load. It also opens the circuit of the transformer secondary 230 so there is no further current flow through the tilt switch 200. The current limiting resistor 222 is employed in this system to prevent a "dead short" of the transformer secondary 230 when the relay coil 215 is shunted by the metal ball 270 when it contacts elements 40 and 44 of the tilt switch.

The full voltage of the transformer secondary is employed across the relay coil when the metal ball contacts elements 42 and 46 of the tilt switch to activate the relay. When the metal ball 270 repositions to cease contact between elements 42 and 46 of the tilt switch, less than the full transformer secondary voltage drop occurs across the relay coil 215 because there is some voltage drop across the current limiting resistor 222 in series with the coil 215. This does not adversely affect the operation of the relay because less electro-magnetic force is required to hold the contact than is required to draw them closed from a gapped position.

In the alternative circuit arrangement disclosed in FIG. 7, the circuit operation will now be described. When the ball 321 bridges contacts 42 and 46, a circuit is completed through the DC adaptor 310, the metal ball 321, and relay 308. This energizes the coil 314 and contact pairs 316(a) and 316(b) close as do contact pair 318(a) and 318(b). The closing of the contact pairs completes the circuit between the load source and pump, and water is supplied to the tank. As the tank fills and the tilt box 300 moves, the ball 321 repositions to bridge contacts 40 and 42. The coil 314 is energized but the load remains on because the latching contact pairs 316(a) and 316(b) and 318(a) and 318(b) remain closed. Once the tank is full, the ball 321 has repositioned to bridge contacts 44 and 40. This completes the circuit through the ball 321 and the DC adaptor 310 to energize coil 312 and opens the closed contact pairs 316(a) and 316(b) and 318(a) and 318(b). The circuit between the load and the pump breaks and water is no longer supplied to the tank.

Figure 8A:
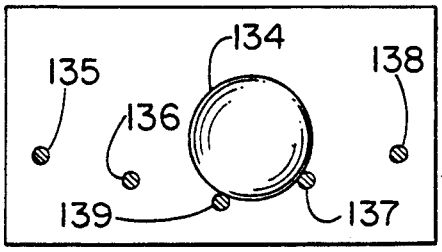
FIG. 8A–8C are cross-sections of alternative embodiments of the tilt switch.
Figure 8B:
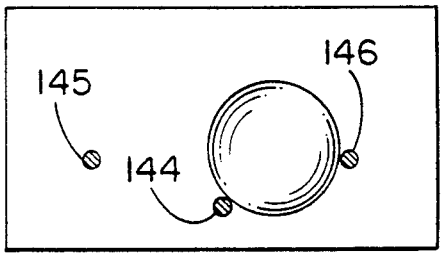
Figure 8C:
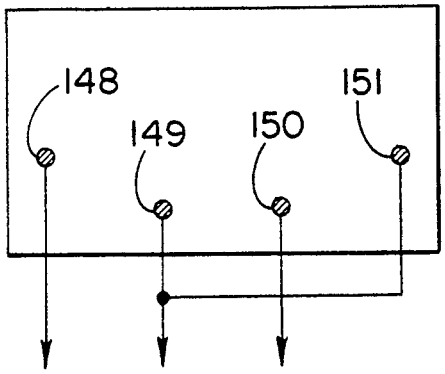

The three position tilt switch 14 or 200 as designated in the first alternative embodiment is used so that more versatility is available, although other position tilt switch will work. A certain number of degrees tilt, such as 25 degrees, is required to reposition the ball. A wider or narrower range of fluid level for each cycle can be chosen by changing the tilt switch Thus a shorter float buoy stem can be used with the three position tilt switch to respond to smaller fluid fluctuations than float buoys with longer stems Alternative arrangements in the tilt switch are shown in FIGS. 8A–8C. The four position tilt switch of 8A is useful if a greater degree of tilt is desired to reposition the ball 134 from the start to stop position. This arrangement has a similar arrangement of contact elements for the three conductors, however, it adds one wire between the intermediate contact elements Contact element 135 is connected to the first conductor of the circuit contact elements 136 and 137 are connected to the intermediate conductor of the circuit arrangement and contact element 138 is connected to the third conductor of the circuit arrangement. Wire 139 spans the interior of the case but is not operatively connected to the circuit arrangement. A two position tilt switch is shown in FIG. 8B. In this arrangement there is only one contact element 144 connected to the intermediate conductor of the circuit arrangement. Contact element 145 is connected to the first conductor of the circuit arrangement and contact element 146 is connected to the third conductor of the circuit arrangement. Although this tilt switch requires a lower degree of tilt between the on and off positions, the telescoping float rod can be adjusted to compensate for the smaller degree of tilt required with this two position tilt switch.

In FIG. 8C contact element 148 is connected to the first conductor of the circuitry. Contact element 149 is connected to the intermediate conductor of the circuit arrangement and contact element 150 is connected to the third conductor of the circuit arrangement. Lastly, contact element 151 is connected to the intermediate conductor. This arrangement cuts the fluid level fluctuation range by about 50%. If the power turns off while the ball bridges 149 and 150 and the fluid level drops repositioning the ball between 150 and 151, the switch will still turn on when power is restored.

This invention has been described with a certain degree of particularity, it is to be understood that the present disclosure has been made only by way of example and that numerous changes in details of construction in arrangement of parts may be resorted to, such as reversing the first and third conductor leads to the tilt switch for automatically lowering the fluid level as in a sump, without departing from the true spirit and scope of the invention.

I claim:

1. A fluid level responsive switch apparatus comprising:

(a) a tubular member having a longitudinal axis and a transverse axis, said tubular member having first and second spaced apart, parallel end walls joined thereto and defining a sealed raceway having a floor surface;

(b) a first and second elongated contact elements extending parallel to one another and aligned with said transverse axis and at a first predetermined elevation relative to said floor surface;

(c) a third elongated contact element positioned adjacent to said first end wall at a second predetermined elevation relative to said floor surface;

(d) a fourth elongated contact element positioned adjacent to said first end wall at a second predetermined elevation relative to said floor surface;

(d) a fourth elongated contact element positioned adjacent to said second end wall at said second predetermined elevation relative to said floor surface;

(e) a conductive ball member disposed in said sealed raceway and movable along said longitudinal axis between said first and second end walls to occupy one of a high fluid level position, an intermediate fluid level position and a low fluid level position depending upon the angle of inclination of said longitudinal axis relative to the horizontal, said ball member in said high fluid level position electrically bridging said first and third contact elements, said ball member in said intermediate fluid level position bridging said first and second contact elements, and said ball member in said low fluid level bridging said second and fourth contact elements;

(f) a motor control circuit means electrically coupled to said first, second, third and fourth contact elements for controlling the on-off state of an electric motor, said motor control circuit including:

i. an alternating current supply;

ii. a control relay having at least a first and a second normally open contact, said control relay being connected to said alternating current supply when said ball member is in said low fluid level position and said control relay being disconnected from said alternating current when said ball member is in said high fluid level position; and (g) means mounting said tubular member to a buoyant object such that said angle of inclination varies in accordance with a fluid level.

2. The fluid level responsive switch apparatus as in claim 1 wherein said means mounting said tubular member comprises a hinge member having a first hinge element adapted for attachment to a fluid tank and a second hinge element pivotally joined to said first hinge element and coupled to said buoyant object, said tubular members being affixed to said second hinge element.

3. The fluid level responsive switch apparatus as in claim 2 wherein said buoyant object is a hollow ball coupled to said second hinge element by an elongated rod.

4. The fluid level responsive switch apparatus as in claim 3 wherein said elongated rod is telescopingly received in said hollow ball.

5. The fluid level responsive switch apparatus as in claim 1, wherein said control relay remains deenergized when said ball member moves from high fluid level position to said intermediate fluid level position.

6. The fluid level responsive switch apparatus as in claim 1 wherein said control relay remains energized when said ball member moves from said intermediate fluid level position to said low fluid level position.

7. A fluid level responsive switch apparatus comprising:

(a) a tubular member having a longitudinal axis and a transverse axis, said tubular member having first and second spaced apart, parallel end walls joined thereto and defining a sealed raceway having a floor surface;

(b) a first and second elongated contact elements extending parallel to said end walls and aligned with said transverse axis and at a first predetermined elevation from said floor surface;

(c) a third elongated contact element positioned adjacent to said first end wall at a second predetermined elevation relative to said floor surface;

(d) a fourth elongated contact element positioned adjacent to said second end wall at said second predetermined elevation relative to said floor surface;

(e) a conductive ball member is disposed in said sealed raceway and moveable along said longitudinal axis between said first and second end walls to occupy one of a high fluid level position, an intermediate fluid level position and a low fluid level position depending upon the angle of inclination of said longitudinal axis relative to the horizontal, said ball member in said high fluid level position electrically bridging said first and third contact elements, and said ball member in said intermediate fluid level position bridging said first and second contact elements, and said wall member in said low fluid level position bridging said second and fourth contact elements;

(f) means mounting said tubular member to a buoyant object such that angle of inclination varies in accordance with a fluid level; and (g) a motor control means electrically coupled to said first, second, third and fourth contact elements for controlling the on-off state of an electric motor, said motor control circuit including:

i. an alternating current supply;

ii. a control relay having at least a first latching contact and a second latching contact, said control relay being connected to said alternating current supply when said ball member is in said low fluid level position and said control relay being disconnected from said alternating current when said ball member is in said high fluid level position.

8. The fluid level responsive switch apparatus as in claim 7 wherein said first latching contact and said second latching contact remain closed when said ball member moves from said low fluid level position to said intermediate fluid level position.

9. The fluid level responsive switch apparatus as in claim 7 wherein said first latching contact and said second latching contact open when said ball member moves from said intermediate fluid level position to said high fluid level position.

10. The fluid level responsive switch apparatus as in claim 7 wherein said means mounting said tubular member comprises a hinge member having a first hinge element adapted for attachment to a fluid tank and a second hinge element pivotally joined to said first hinge element and coupled to said buoyant object, said tubular member being affixed to said second hinge element.

11. The fluid level responsive switch apparatus as in claim 10 wherein said buoyant object is a hollow ball coupled to said second hinge element by an elongated rod.

12. The fluid level responsive switch apparatus as in claim 11 wherein said elongated rod is telescopingly received in said hollow ball.

13. A fluid level responsive switch apparatus comprising:

(a) a casing having a longitudinal axis and a transverse axis, said casing having first and second spaced apart, parallel end walls joined thereto and defining a sealed raceway having a floor surface;

(b) a first elongate contact element extending parallel to said end walls and aligned with said transverse axis and at a first predetermined elevation from said floor surface;

(c) a second elongated contact element positioned adjacent to said first end wall at a second predetermined elevation relative to said floor surface;

(d) a third elongated contact element positioned adjacent to said second end wall at said second predetermined elevation relative to said floor surface;

(e) a conductive ball member disposed in said sealed raceway and movable along said longitudinal axis between said first and second end walls to occupy one of a high fluid level position and a low fluid level position depending upon the angle of inclination of said longitudinal axis relative to the horizontal, said ball member in said high fluid level position electrically bridging said first and second contact elements, and said ball member in said low fluid level position bridging said first and second contact elements; and (f) means mounting said tubular member to a buoyant object such that said angle of inclination varies in accordance with a fluid level.

14. The fluid level responsive switch apparatus as in claim 13 wherein said means mounting said casing comprises a hinge member having a first hinge element adapted for attachment to a fluid tank and a second hinge element pivotally joined to said first hinge element and coupled to said buoyant object, said casing being affixed to said second hinge element.

15. The fluid level responsive switch apparatus as in claim 13 and further including a motor control circuit means electrically coupled to said first, second, and third contact elements for controlling the on-off state of an electric motor.

16. The fluid level responsive switch apparatus as in claim 15 wherein said motor control circuit comprises:

(a) an alternating current supply;

(b) a motor control relay having a first plurality of normally open contacts for contacting said alternating current supply to said electric motor when said motor control relay is energized;

(c) a first control relay having a normally closed contact, said first control relay being connected to said alternating current supply when said ball member is in said high fluid level position;

(d) a second control relay having a second plurality of normally open contacts, said second control relay being connected to said alternating current supply when said ball member is in said low fluid level position; and (e) means for connecting said second plurality of normally open contacts for said second control relay in series between said alternating current supply and said motor control relay.

17. The fluid level responsive switch apparatus as in claim 13 further including wire means for a second and third intermediate fluid level position, said wire means aligned with said transverse axis at a third predetermined elevation relative to said floor surface.

18. The fluid level responsive switch apparatus as in claim 1 wherein said fourth elongated contact element is operably connected to said first elongated contact element.

* * * * *

UNITED STATES PATENT AND TRADEMARK OFFICE

CERTIFICATE OF CORRECTION

PATENT NO. : 5,281,858
DATED : January 25, 1994
INVENTOR(S) : Arthur Langved

It is certified that error appears in the above-indentified patent and that said Letters Patent is hereby corrected as shown below:

In column 12, line 27, please delete

"contacting"

and insert

-- connecting --;

In column 12, line 40, please delete

"for"

and insert

-- of --.

Signed and Sealed this

Twenty-sixth Day of July, 1994

*Attest:*

*Attesting Officer*

BRUCE LEHMAN

*Commissioner of Patents and Trademarks*